US008317244B1

(12) United States Patent
Schuyleman

(10) Patent No.: US 8,317,244 B1
(45) Date of Patent: Nov. 27, 2012

(54) APPARATUS AND METHOD FOR POSITIONING AN OBJECT IN A BUILDING

(76) Inventor: Jay Wesley Schuyleman, Duvall, WA (US)

( * ) Notice: Subject to any disclaimer, the term of this patent is extended or adjusted under 35 U.S.C. 154(b) by 462 days.

(21) Appl. No.: 12/540,286

(22) Filed: Aug. 12, 2009

Related U.S. Application Data

(60) Provisional application No. 61/090,972, filed on Aug. 22, 2008.

(51) Int. Cl.
*B66C 1/10* (2006.01)
*B66C 1/00* (2006.01)

(52) U.S. Cl. ..... 294/67.5; 294/81.3

(58) Field of Classification Search ..... 294/15, 294/17, 67.5, 67.1, 67.21, 81.3, 81.4, 81.5, 294/81.21, 81.54; 182/2.11, 63.1; 414/10, 414/11, 607; 212/231, 347; 254/8 B, 124
See application file for complete search history.

(56) References Cited

U.S. PATENT DOCUMENTS 765,674 A * 7/1904 Normandin ..... 294/15
2,193,054 A * 3/1940 Bowen ..... 294/15
3,675,961 A * 7/1972 Wheeler ..... 294/67.1
3,741,409 A * 6/1973 Painter ..... 414/733
3,759,399 A * 9/1973 Glass et al. ..... 414/607
4,017,109 A * 4/1977 Belinsky ..... 294/67.21
4,251,098 A * 2/1981 Belinsky ..... 294/67.21
4,314,622 A * 2/1982 Lindquist ..... 182/2.11
4,671,721 A * 6/1987 Pratt et al. ..... 414/10
D346,474 S * 4/1994 Lindgren ..... D34/35
5,312,218 A 5/1994 Pratt et al.
5,803,520 A * 9/1998 Bagrowski, III ..... 294/67.5
6,048,012 A 4/2000 Selby et al.
6,820,907 B1 * 11/2004 Haynes ..... 294/63.1
7,017,963 B1 3/2006 Setzke et al.

* cited by examiner

*Primary Examiner* — Paul T Chin
(74) *Attorney, Agent, or Firm* — QuickPatents, Inc.; Kevin Prince

(57) ABSTRACT

An offset hoisting apparatus comprises a rigid boom having a hook at a distal end thereof. The offset hoisting apparatus further includes a front mount having a front boom aperture and a rear mount having a rear boom aperture, each being adapted for confining the boom to slidably move therethrough. The invention has a slip collar having a slip collar boom aperture therein for receiving the boom therethrough and an offset hoisting apparatus attachment having a flexible linkage fixed at a distal end thereof with the slip collar. The boom is selectively slid between a retracted and an extended position and the load is secured to the hook. The crane apparatus then lifts and positions the load to a building.

17 Claims, 3 Drawing Sheets

APPARATUS AND METHOD FOR POSITIONING AN OBJECT IN A BUILDING

CROSS-REFERENCE TO RELATED APPLICATIONS

This application claims the benefit of U.S. Provisional Patent Application 61/090,972, filed on Aug. 22, 2008, and incorporated herein by reference.

STATEMENT REGARDING FEDERALLY SPONSORED RESEARCH AND DEVELOPMENT

Not Applicable.

FIELD OF THE INVENTION

This invention relates to a hoisting apparatus, and more particularly to an apparatus for use with a crane in positioning an object at a desired distance inside an opening of a building.

DISCUSSION OF RELATED ART

Tall buildings are generally constructed as a shell with openings for panels and windows or the like. Precast or prefabricated panels are then placed within these openings which are usually finished before installation. Columns and beams are the most common precast concrete structures constructed in a factory and later transported to the site. Maneuvering of reinforced concrete panels is difficult since such panels with large dimensions are extremely heavy. There have been numerous methods of lifting and positioning precast concrete structures in houses, office buildings or other concrete structures.

U.S. Pat. No. 3,675,961 to Wheeler on Jul. 11, 1972 provides a horizontal load positioner connectable to the end of a hoist line for horizontally placing a load within an opening or for horizontally removing the load from the opening in a building. As such, the workers at the opening on the building grab the panel and pull the panel into the opening. Further, if the panel is large and heavy, the workers must manually pull the panel into the opening. The workers pulling the panel into the opening may therefore accidentally fall and, unfortunately, may get killed.

U.S. Pat. No. 4,671,721 to Pratt on Jun. 9, 1987 directs to an apparatus positioned between the cables connecting with a crane and the panel to be elevated to the opening in the building under construction. The panel is attached to the front of the apparatus approximately four feet to the front of the crane attachment to the apparatus. With the panel four feet ahead of the apparatus, it is possible by a crane to maneuver the apparatus and place the panel close to the opening in the building even though the opening is recessed as much as three feet inside of the spandrel beam. Such an apparatus is inconvenient for use due to the exact four feet distance of the panel from the crane attachment, which prevents the adjustment of the distance of the panel from the apparatus as desired.

One prior art apparatus, taught in U.S. Pat. No. 4,769,960 issued to Zipf on Sep. 13, 1988 discloses a coupler for hanging, picking up and conveying prefabricated concrete bodies, such as panels and the like. The coupler engages with a pin embedded in a body and adapts to be supported by a rope or cable of a hoist. The shortcomings of the apparatus are that the process of positioning the panel in the opening of the building is complex and time consuming. Moreover, since the workers must be paid for installing the panel in the building, the expense may rise if the process is time consuming.

Therefore, there is a need for an apparatus that is less time consuming and less expensive to use in positioning the load such as the precast panel in an opening of a building. Such a needed apparatus would selectively position the load at a desired distance inside the opening without having to manually do it. Moreover, such an apparatus would be easier and safer to place the precast panel in a recessed opening of the building. The present invention accomplishes these objectives.

SUMMARY OF THE INVENTION

The present invention is an improvement for an offset hoisting apparatus for use with a crane apparatus to lift a load. The offset hoisting apparatus comprises a rigid boom having a distal end and a proximal end. The distal end of the boom includes a hook means for supporting the load. The offset hoisting apparatus further includes a front mount having a front boom aperture and a rear mount having a rear boom aperture, each boom apertures adapted for confining the boom to slidably move therethrough. The front mount and the rear mount are each selectively mounted to the offset hoisting apparatus with a clamping means.

The apparatus has a slip collar having a slip collar boom aperture therein for receiving the boom therethrough and an offset hoisting apparatus attachment means. The offset hoisting apparatus attachment means includes at least one flexible linkage fixed at a distal end thereof with the slip collar and fixed at a proximal end thereof with at least one vertical extension frames. The flexible linkage further includes a length adjusting means. The slip collar includes at least one pin aperture therein, such that the slip collar is fixed to the boom at the slip collar boom aperture thereof with at least one pin.

The rigid boom includes a plurality of pin apertures. Each of the front mount and the rear mount include corresponding pin apertures. The apparatus includes at least one pin, such that with the at least one pin traversing at least one of the pin apertures of either the front mount or rear mount and one of the apertures of the boom, the boom is thus prevented from slidable movement with respect to the offset hoisting apparatus.

In use, the boom is selectively slid between a refracted position and an extended position, or therebetween. The load is then secured to the hook means at the distal end of the boom. The crane apparatus is then able to lift and position the load to a building.

The present apparatus facilitates less time consumption and less expense in positioning the load such as a precast panel in an opening of the building. Such an apparatus selectively positions the load at a desired distance inside the opening without pulling the precast panel by the workers. Moreover, the apparatus is easier and safer to place the precast panel in a recessed opening of the building. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. Any use of the word "means" herein is intended to invoke means-plus-function limitation in accordance with 35 U.S.C. §112, sixth paragraph, even if the word "means" follows words describing the function.

Figure 1:
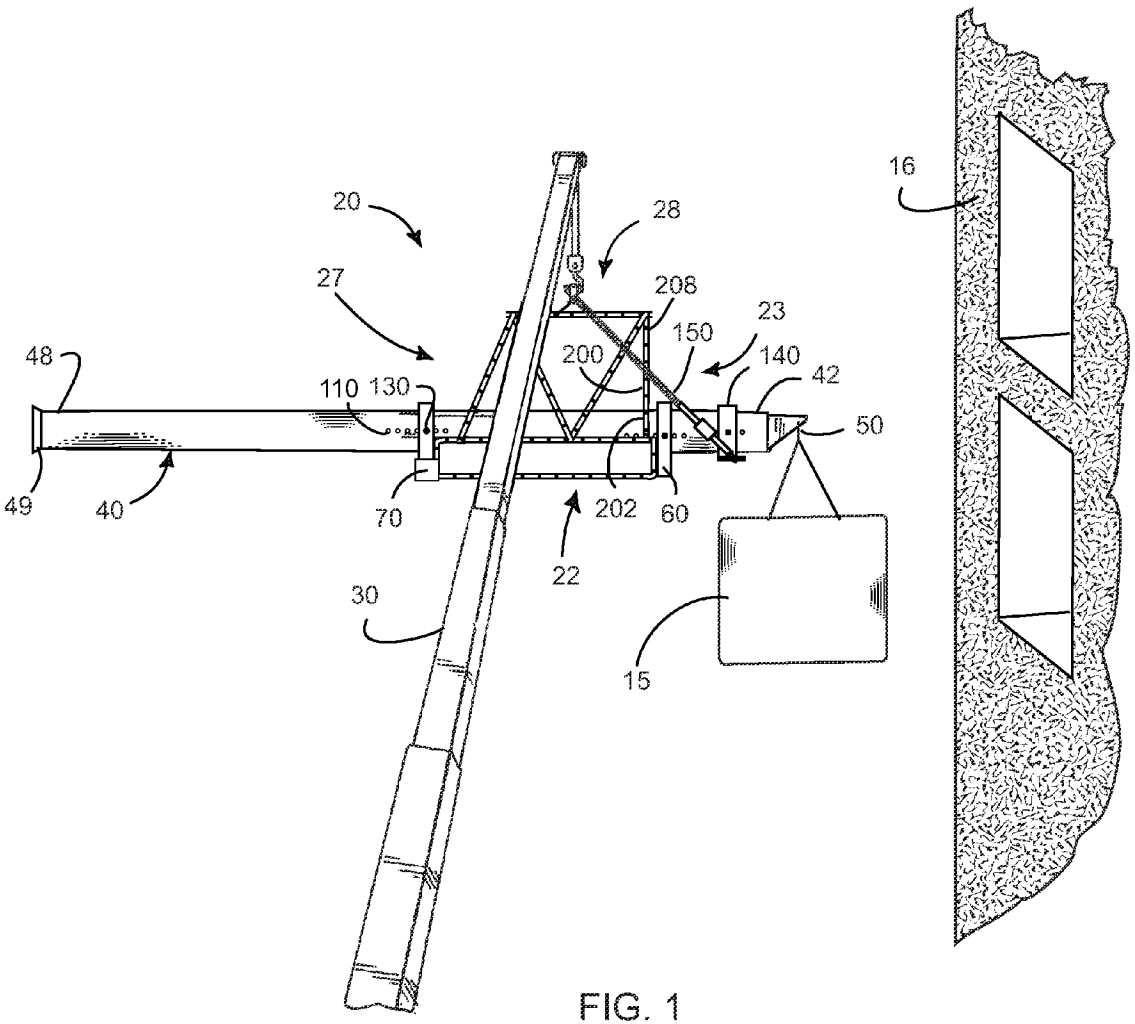
FIG. 1 is a perspective view of the invention in use.

FIG. 1 shows an improvement 10 for an offset hoisting apparatus 20 for use with a crane apparatus 30 to lift a load 15. The offset hoisting apparatus 20 includes a top side 28, a bottom side 22, a front side 23, and a rear side 27. The offset hoisting apparatus 20 (FIG. 2) comprises a rigid boom 40 having a distal end 42 and a proximal end 48. The distal end 42 of the boom 40 includes a hook means 50 for supporting the load 15.

The offset hoisting apparatus 20 further includes a front mount 60 (FIG. 4) having a front boom aperture 62 adapted for confining the boom 40 to slidably move therethrough. The front mount 60 is fixed with the offset hoisting apparatus 20. The front boom aperture 62 includes a low friction surface 100 for contacting the boom 40.

A rear mount 70, having a rear boom aperture 72 (FIG. 5), is further included that is adapted for confining the boom 40 to slidably move therethrough. The rear mount 70 is fixed with the offset hoisting apparatus 20. The boom 40 passes through the rear boom aperture 72 having a low friction surface 100. The low-friction surface 100 of each the front boom aperture 62 and rear boom aperture 72 is a low-friction ultrahigh molecular weight (UHMW) polymer material. A protrusion 49 at the proximal end 48 of the boom 40 prevents the boom 40 from falling off through the front mount 60 or the rear mount 70.

The front mount 60 and the rear mount 70 are each selectively mounted to the offset hoisting apparatus 20 with a clamping means 190. The clamping means 190 is at least one bolt and nut 192. The front mount 60 may be fixed with the front side 23 of the offset hoisting apparatus 20 when the rear mount 70 is fixed with the top side 28 of the offset hoisting apparatus 20. The front mount 60 may also be fixed with the top side 28 of the offset hoisting apparatus 20 when the rear mount 70 is fixed with the top side 28 of the offset hoisting apparatus 20. The front mount 60 may be fixed with the front side 23 of the offset hoisting apparatus 20 when the rear mount 70 is fixed with the bottom side 22 of the offset hoisting apparatus 20. The front mount 60 may also be fixed with the bottom side 22 of the offset hoisting apparatus 20 when the rear mount 70 is fixed with the bottom side 22 of the offset hoisting apparatus 20.

Figures 3, 4, 5:
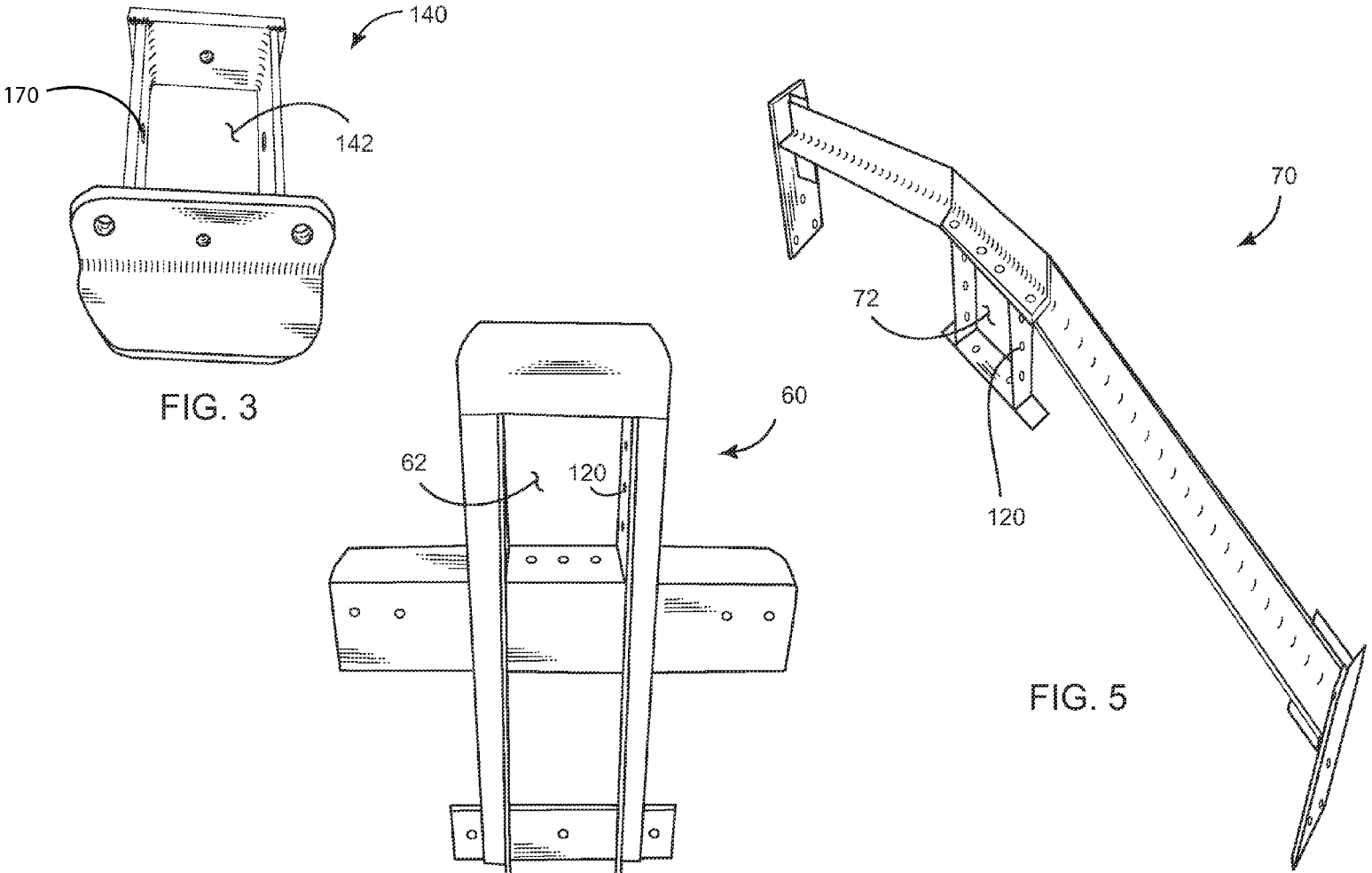
FIG. 3 is a perspective bottom side elevational view of a slip collar of the invention.
FIG. 4 is a perspective front elevational view of a front mount of the invention.
FIG. 5 is a perspective side elevational view of a rear mount of the invention.

As in FIG. 3, the invention includes a slip collar 140 having a slip collar boom aperture 142 therein for receiving the boom 40 therethrough and an offset hoisting apparatus attachment means 150. The offset hoisting apparatus attachment means 150 includes at least one flexible linkage 160 fixed at a distal end 168 thereof with the slip collar 140 and fixed at a proximal end 162 thereof with the offset hoisting apparatus 20. The flexible linkage 160 further includes a length adjusting means 180. The length adjusting means 180 includes a flange 184 attached to a stationary rod 182. In the preferred embodiment, the flexible linkage 160 is a length of metal chain 186. The length adjusting means 180 is a turnbuckle 181. The slip collar 140 includes at least one pin aperture 170 therein, such that the slip collar 140 is fixed to the boom 40 at the slip collar boom aperture 142 thereof with at least one pin 130.

The offset hoisting apparatus attachment means 150 further includes at least one vertical extension frame 200 fixed to the offset hoisting apparatus 40 at a lower end 202 thereof.

The proximal end 162 of each flexible linkage 160 is fixed to an upper end 208 of one of the at least one vertical extension frames 200.

The rigid boom 40 includes a plurality of pin apertures 110. Each of the front mount 60 and the rear mount 70 includes corresponding pin apertures 120. The apparatus includes at least one pin 130, such that with the at least one pin 130 traversing at least one of the pin apertures 120 of either the front mount 60 or the rear mount 70 and one of the apertures 110 of the boom 40, the boom 40 is thus prevented from slidable movement with respect to the offset hoisting apparatus 20.

Figure 2:
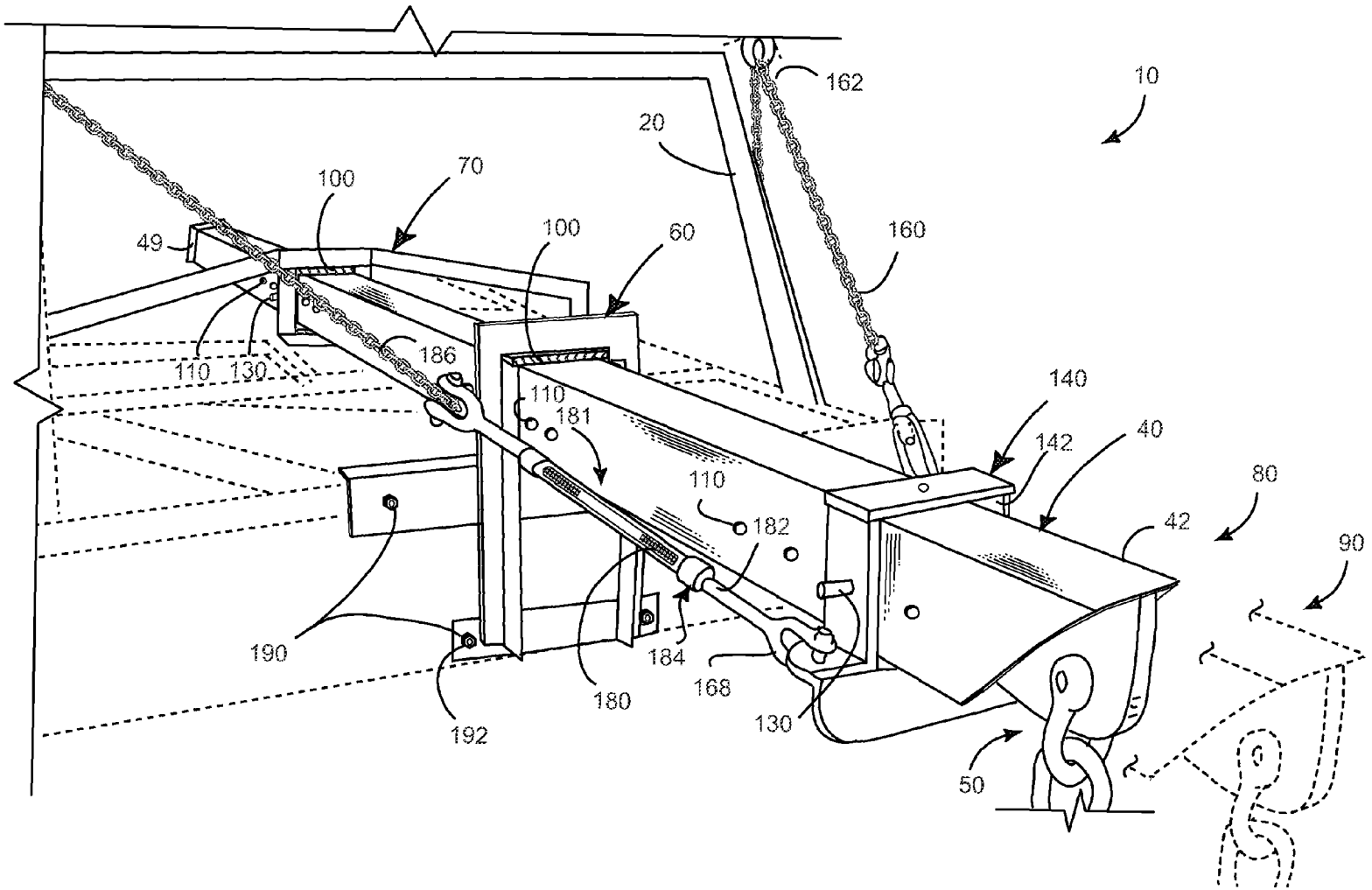
FIG. 2 is a perspective cut-away view of the invention, illustrating a boom in a refracted position.

In use, the boom 40 is selectively slid between a retracted position 80 and an extended position 90, or therebetween (FIG. 2). The load 15 is then secured to the hook means 50 at the distal end 42 of the boom 40. The crane apparatus 30 is then able to lift and position the load 15 to a building 16. The offset hoisting apparatus 20 can thereby lift load like building material to a desired opening or to a desired location in the building 16 or to a tower under construction such as a high voltage electric line tower, a radio and television tower and the like.

While a particular form of the invention has been illustrated and described, it will be apparent that various modifications can be made without departing from the spirit and scope of the invention. For example, various offset hoisting apparatus attachment means 150 may be employed in order to support the boom 40. Accordingly, it is not intended that the invention be limited, except as by the appended claims.

The teachings provided herein can be applied to other systems, not necessarily the system described herein. The elements and acts of the various embodiments described above can be combined to provide further embodiments. All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

These and other changes can be made to the invention in light of the above Detailed Description. While the above description details certain embodiments of the invention and describes the best mode contemplated, no matter how detailed the above appears in text, the invention can be practiced in many ways. Details of the system may vary considerably in its implementation details, while still being encompassed by the invention disclosed herein.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention under the claims.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. An improvement for an offset hoisting apparatus having at least a top side, a bottom side, a front side, and a rear side, the offset hoisting apparatus for use with a crane apparatus to lift a load, the improvement comprising:

a rigid boom having a distal end and a proximal end, the distal end including a hook means for supporting the load;

a front mount having a front boom aperture adapted for confining the boom to slidable movement therethrough, the front mount fixed with the offset hoisting apparatus, the distal end cantilevered from the front mount to extend the load through an opening in a wall; and a rear mount having a rear boom aperture adapted for confining the boom to slidable movement therethrough, the rear mount fixed with the offset hoisting apparatus;

whereby the boom may be selectively slid between a retracted and an extended position, or therebetween, and the load may then be secured to the hook means at the distal end of the boom, the crane apparatus then able to lift the load.

2. The improvement of claim 1 wherein each boom aperture further includes a lowfriction surface for contacting the boom.

3. The improvement of claim 2 wherein the low-friction surface is a low-friction ultrahigh molecular weight (UHMW) polymer material.

4. The improvement of claim 1 wherein the boom includes a plurality of pin apertures, and wherein the front and rear mounts each include corresponding pin apertures, at least one pin being further included, such that with the at least one pin traversing at least one of the apertures of either the front or rear mount and one of the apertures of the boom, the boom is prevented from slidable movement with respect to the offset hoisting apparatus.

5. The improvement of claim 1 further including a slip collar having a slip collar boom aperture therein for 'receiving the boom therethrough and an offset hoisting apparatus attachment means.

6. The improvement of claim 5 wherein the offset hoisting apparatus attachment means includes at least one flexible linkage fixed at a distal end thereof with the slip collar and fixed at a proximal end thereof with the offset hoisting apparatus.

7. The improvement of claim 6 wherein each flexible linkage further includes a length adjusting means.

8. The improvement of claim 7 wherein the length adjusting means is a turnbuckle.

9. The improvement of claim 6 wherein each flexible linkage is a length of metal chain.

10. The improvement of claim 6 wherein the offset hoisting apparatus attachment means further includes at least one vertical extension frame fixed to the offset hoisting apparatus at a lower end thereof, the proximal end of each flexible linkage being fixed to an upper end of one of the at least one vertical extension frames.

11. The improvement of claim 5 wherein the slip collar includes at least one pin aperture therein, such that the slip collar may be fixed to the boom at an aperture thereof with at least one of the pins.

12. The improvement of claim 1 wherein the front mount and rear mount are each selectively mounted to the offset hoisting apparatus with a clamping means.

13. The improvement of claim 12 wherein each clamping means is at least one bolt and nut.

14. The improvement of claim 1 wherein the front mount is fixed with the front side of the offset hoisting apparatus and the rear mount if fixed with the top side of the offset hoisting apparatus.

15. The improvement of claim 1 wherein the front mount is fixed with the top side of the offset hoisting apparatus and the rear mount if fixed with the top side of the offset hoisting apparatus.

16. The improvement of claim 1 wherein the front mount is fixed with the front side of the offset hoisting apparatus and the rear mount if fixed with the bottom side of the offset hoisting apparatus.

17. The improvement of claim 1 wherein the front mount is fixed with the bottom side of the offset hoisting apparatus and the rear mount if fixed with the bottom side of the offset hoisting apparatus.

* * * * *